US009021763B2

(12) United States Patent
Rush

(10) Patent No.: US 9,021,763 B2
(45) Date of Patent: May 5, 2015

(54) REINFORCEMENT BAR POSITIONING SYSTEM

(76) Inventor: Michael G. Rush, Sioux City, IA (US)

( * ) Notice: Subject to any disclaimer, the term of this patent is extended or adjusted under 35 U.S.C. 154(b) by 1 day.

(21) Appl. No.: 12/717,230

(22) Filed: Mar. 4, 2010

(65) Prior Publication Data

US 2011/0214380 A1 Sep. 8, 2011

(51) Int. Cl.

| | |
|---|---|
| ***E04C 5/16*** | (2006.01) |
| ***E04G 21/18*** | (2006.01) |
| ***E04C 5/18*** | (2006.01) |

(52) U.S. Cl.
CPC ..... *E04G 21/1841* (2013.01); *E04C 5/18* (2013.01)

(58) Field of Classification Search
CPC ..... E04G 21/1841; E04C 5/18; E04C 5/168; E04C 1/16
USPC ..... 52/677–686
See application file for complete search history.

(56) References Cited

U.S. PATENT DOCUMENTS

| | | | |
|---|---|---|---|
| 3,861,096 | A | 1/1975 | Emmons |
| 4,589,244 | A | 5/1986 | Dreizler |
| 4,598,523 | A | 7/1986 | Tolliver |
| 5,535,565 | A | 7/1996 | Majnaric |
| 5,752,860 | A | 5/1998 | Greaves |
| 5,845,449 | A | 12/1998 | Vaughan |
| 6,378,260 | B1 | 4/2002 | Williamson |
| 6,591,574 | B2 | 7/2003 | Humphrey |
| 6,658,810 | B2 | 12/2003 | DeLoach |
| 6,898,912 | B2 | 5/2005 | Bravinski |
| 2005/0284093 | A1 | 12/2005 | Foucher |
| 2007/0044423 | A1 | 3/2007 | Funk |
| 2007/0209310 | A1 | 9/2007 | Papke |
| 2008/0168734 | A1 | 7/2008 | Degen |
| 2009/0056258 | A1 | 3/2009 | Currier |
| 2009/0249725 | A1 | 10/2009 | McDonagh |

FOREIGN PATENT DOCUMENTS

| | | |
|---|---|---|
| DE | 2323771 | 11/1974 |

*Primary Examiner* — Mark Wendell
(74) *Attorney, Agent, or Firm* — Jeffrey A. Proehl; Woods Fuller Shultz & Smith P.C.

(57) ABSTRACT

A reinforcement bar positioning device may comprise an elongated main member having a longitudinal axis, with the main member defining a pair of apertures spaced from each other along the longitudinal axis. The positioning device may also comprise at least one securing member mounted on the main member and configured to secure a reinforcement bar in one of the apertures of the main member.

20 Claims, 4 Drawing Sheets

REINFORCEMENT BAR POSITIONING SYSTEM

BACKGROUND

1. Field

The present disclosure relates to reinforcement bar support devices and more particularly pertains to a new reinforcement bar positioning system for securely positioning reinforcement bars with respect to each other.

2. Description of the Prior Art

Reinforcing or reinforcement bars (sometimes referred to as "rebar" or re-bar") are used to reinforce concrete, and the concrete being reinforced is typically poured or placed about the bars so that the bars are incorporated in the concrete after it has set up. Reinforcement bars are typically positioned in a particular configuration in the concrete in a manner that provides a maximum degree of reinforcing strength to the concrete. This positioning is often a grid of the reinforcement bars that extends generally parallel to the main surfaces of the slab or wall. In concrete walls, a pair of substantially grids of reinforcement bars may be utilized.

The spacing of the bars of the grids, and well as the positioning of the grids in the finished wall is important in order to obtain the highest degree of reinforcement for the concrete. Therefore, the positioning of the bars of the grids in the form cavity before and during the placement of the concrete in the form is important. Due to the significant weight of the concrete and the typical pouring of the concrete from above the form into the cavity, the concrete exerts significant pressure on the reinforcement bars in the form cavity and can dislodge and move out of position any bar that is not sufficiently secured or supported.

SUMMARY

In view of the foregoing, the present disclosure describes a new reinforcement bar positioning system which may be utilized for securely positioning reinforcement bars with respect to each other.

In one aspect, the present disclosure relates to a reinforcement bar positioning device which may comprise an elongated main member having a longitudinal axis, with the main member defining a pair of apertures spaced from each other along the longitudinal axis. The device may also comprise at least one securing member mounted on the main member and configured to secure a reinforcement bar in one of the apertures of the main member.

In another aspect, the present disclosure relates a reinforcement bar positioning device that may comprise an elongated main member having a longitudinal axis, with the main member defining a pair of apertures spaced from each other along the longitudinal axis. The device may also comprise a pair of securing members movably mounted on the main member, with each of the securing members being configured to secure a reinforcement bar in one of the apertures of the main member. Each of the securing members may be movable on the main member such that each of the securing members is movable between a receiving position and a securing position.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, as well the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
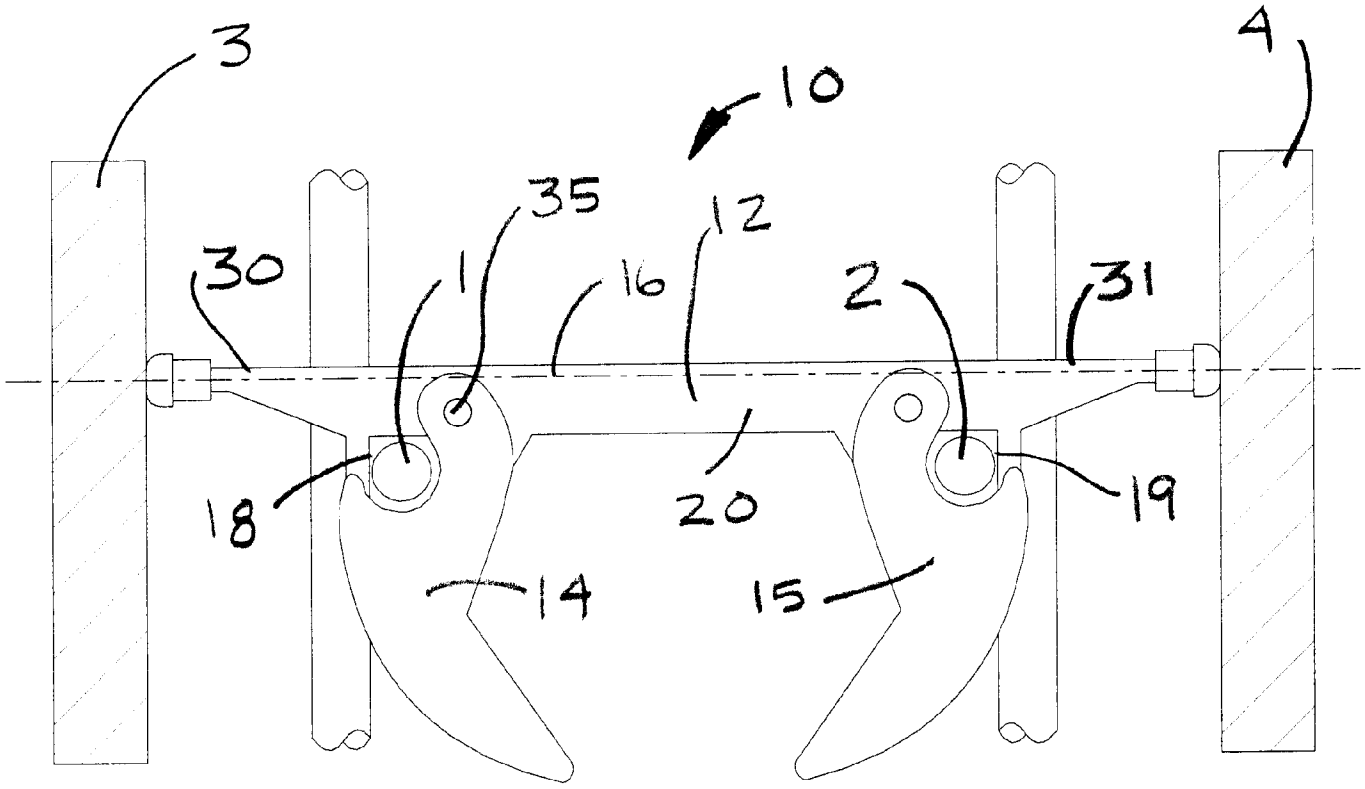
FIG. 1 is a schematic side view of a new reinforcement bar positioning device according to the present disclosure and shown in relation to a pair of reinforcement bars, with the securing members shown in the securing position.
Figure 2:
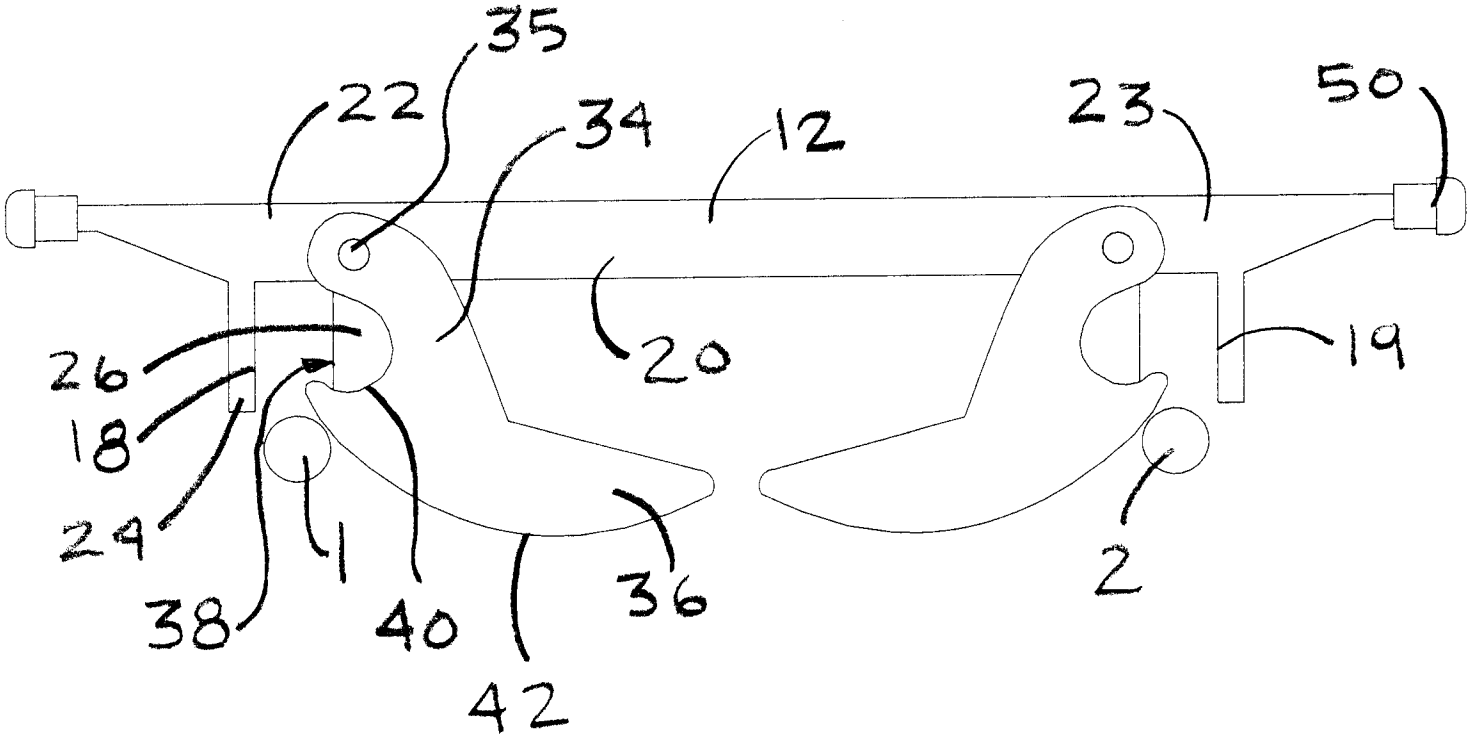
FIG. 2 is a schematic side view of the positioning device shown with the securing members in the receiving position, according to an illustrative embodiment.
Figure 3:
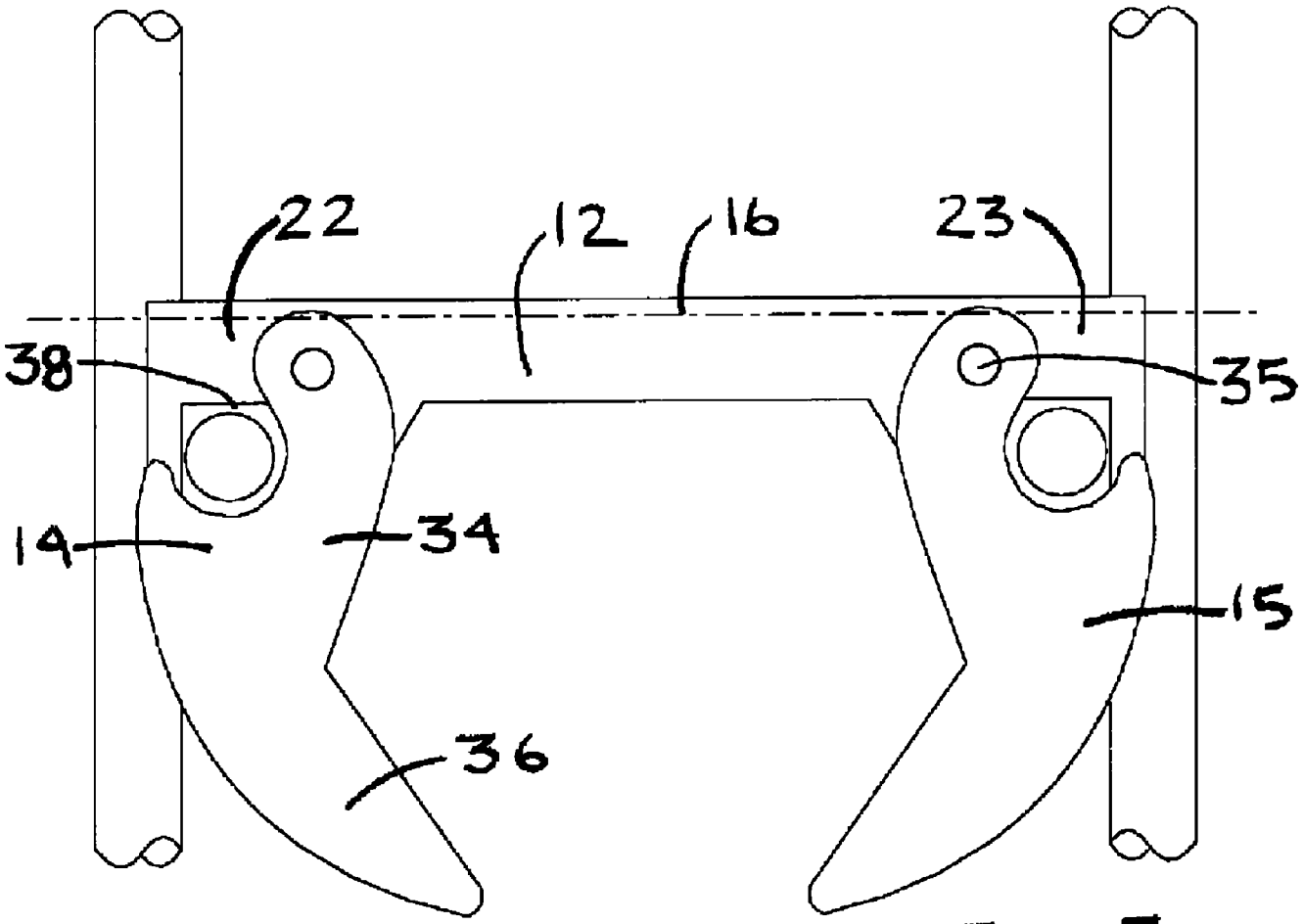
FIG. 3 is a schematic side view of the positioning device according to an illustrative embodiment in which the main member does not include positioning portions.
Figure 4:
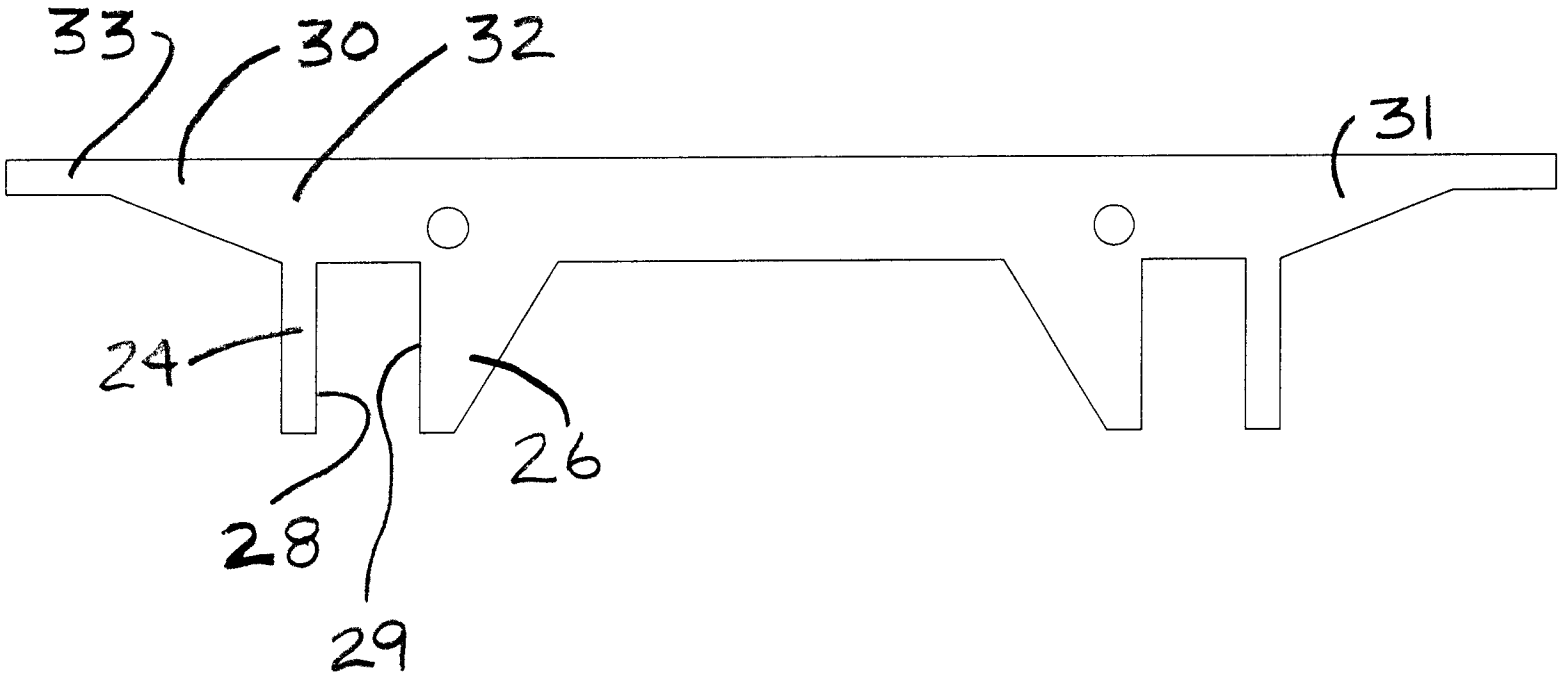
FIG. 4 is a schematic side view of the main member of the positioning device with the securing members removed to reveal detail of the main member.

With reference now to the drawings, and in particular to FIGS. 1 through 4 thereof, a new reinforcement bar positioning system embodying the principles and concepts of the disclosed subject matter will be described.

The disclosure relates to a reinforcement bar positioning device 10 that is highly suitable for positioning, and holding in position, reinforcing or reinforcement bars 1, 2 (sometimes referred to as "rebar" or re-bar") used to reinforce concrete. The device 10 is especially suitable for use with reinforcement bars in a form for a substantially vertical concrete wall in which two reinforcement bars are positioned in a lateral (and typically horizontally spaced) relationship, such as when two mats or grids of reinforcement bars are fabricated and positioned in layers in the thickness dimension of the wall to be formed.

In general, the bar positioning device 10 may comprise a main member 12 and at least one 14, and preferably a pair 14, 15, of securing members are connected to the main member 12 for removable securing one or more reinforcement bars to the main member so as to secure the bar in the desired positioning.

The main member 12 may comprise an elongated member with a longitudinal axis 16. The main member 12 defines at least one aperture 18, and preferably defines a pair of spaced apertures 18 and 19. Each aperture of the pair of apertures 18, 19 open in a direction that is lateral to the longitudinal axis 16, and the openings of the apertures may be located on a same lateral side of the longitudinal axis of the main member. In greater detail, the main member 12 may comprise a central spacing portion 20 and a pair of end portions 22, 23 that are positioned on opposite ends of the central spacing portion. The length of the central spacing portion 20 along the longitudinal axis may be made longer or shorter to thereby increase or decrease the spacing or separation of the apertures 18 and 19 to correspond to the desired or required separation of the reinforcement bars 1, 2.

Each of the end portions 22, 23 may thus define a respective one of the apertures 18, 19, and each of the end portions 22, 23 may comprise an aperture-defining structure, which may include an outer extension 24, and may also include an inner extension 26. The outer extension 24 may extend generally in a direction that is lateral to the longitudinal axis 16 of the main member. The outer extension 24 may have an inward surface 28 along side of the aperture. The inner extension 26 may also extend generally in a direction that is lateral to the longitudinal axis 16 of the main member, and may extend in an orientation that is substantially parallel to the outer extension 24. The inner extension 26 may have an inward surface 29 which may be spaced from the inward surface 28 of the inner extension such that the inward surface of the outer extension and the inward surface of the inner extension define the aperture. The inward surfaces 28, 29 of the extensions may be oriented substantially parallel to each other.

In some embodiments of the device 10, the main member 12 may include at least one positioning portion 30 that is utilized to abut against the inner surface of one of the form walls 3, 4 to maintain the device in a desirable position with respect to the inner surfaces of the form wall, and to thereby maintain the desired spacing of the reinforcement bars engaged by the device 10 away from the inner surfaces of the form walls. The positioning portion 30 may extend from one of the end portions 22, 23, and extends in a substantially longitudinal direction from the end portion. The positioning portion 30 has a base end 32 and a free end 33 that is located opposite of the base end. The base end 32 may be connected to the end portion 22, 23, and may preferably be formed of the same piece of material. The free end 33 may be located in a longitudinal direction from the base end 32, and may be adapted for contacting or abutting the inner surface of the one of the form walls. The device 10 may include a pair of positioning portions 30, 31 for contacting opposite inner surfaces of the form walls so that the device is suitably oriented with respect to the form walls. Each of the positioning portions 30, 31 may extend in substantially opposite and substantially longitudinal directions from the respective end portions 22, 23. The length of each of the positioning portions as measured between the base and free ends may be made longer or shorter to increase or decrease the distance between the reinforcement bar in the adjacent aperture and the inner surface of the form wall. Optionally, a cap 50 may be placed in the free end of the positioning portion The securing member or members 14, 15 may removably secure one or more reinforcement bars 1, 2 to the main member 12. The securing members may be mounted on the main member 12, and may be movably mounted on the main member. The securing members may be movable between a receiving position (see FIG. 2) and a securing position (see FIG. 1). The receiving position of each securing members may be characterized by the securing member being positioned so as to permit a reinforcing bar 4 to move into the aperture 18 of the main member. The securing position of each securing member may be characterized by the securing member being positioned to block removal of a reinforcing bar from the aperture of the main member, at least not without moving the securing member toward the receiving position. The securing member may be pivotally mounted on the main member, such as by a pivot 35, so that the movement of the securing member with respect to the main member is a pivotal movement. The securing member may be biased toward the securing position by the weight of the securing member when the device 10 is held with the longitudinal axis in a substantially horizontal orientation with the apertures opening downwardly. The biasing of the securing member may be accomplished by the configuration of the mass of the member with respect to the pivot connection of the securing member to the main member. Optionally, other means may be employed to bias the securing member, such as a spring acting on the securing member, but the configuration of the weight is highly preferable due to its simplicity.

Each of the securing members 14, 15 may comprise a latching portion 34 and optionally may include a deflection portion 36. The latching portion 34 may form a closed perimeter with the outer extension 24 of the end portion when the securing member 14 is in the securing position. The latching portion 34 may close the opening of the aperture 18 of the main member when the latching portion is in the securing portion. The latching portion 34 may be moved away from the opening of the aperture when the latching portion is moved from the securing position of the securing member toward the receiving position.

The latching portion 34 of the securing member may define a notch 38 which may be alignable with the aperture 18 of the main member 12 when the latching portion is the securing portion. The notch 38 may open in a longitudinally-outward direction when the securing member is in the securing position. The latching portion 34 may include a notch-defining edge 40 which may be arcuate in shape although this shape is not critical.

The deflection portion 36 may be configured to deflect the securing member 14 from the securing position toward the receiving position when the deflection portion is contacted by a reinforcing bar 1. The deflection portion 36 may have a deflection edge 42 that is positioned to contact a reinforcing bar when the reinforcement bar is moved toward the end portion of the main member, or when the device 10 is moved toward the reinforcement bar so that the deflection edge 42 contacts the bar. The deflection edge 42 may be substantially arcuate in shape, although this shape is not critical. The deflection edge 42 may intersect with the notch-defining edge 40 at a juncture.

In some embodiments, the notch-defining edge 40 may have a section adjacent to the juncture of the notch-defining edge 40 and the deflection edge 42 that extends substantially parallel to the longitudinal axis 16 of the main member when the securing member is in the securing position, and this section may help to resist the movement of a bar 1 out of the aperture by movement of the securing member toward the receiving position when the bar applies force to the section of the notch-defining edge. In other embodiments, the notch-defining edge may be curved toward the juncture with the deflection edge 42 create more of a hook to hold the bar in the aperture in the aperture once the bar has moved past the deflection edge and the securing member has moved from the receiving position toward the securing position.

Each of the securing members 14, 15 may be associated with one of the end portions 22, 23 of the main member 12, and the securing members may be oriented on the main member in a substantially mirror image relationship, so that one of the securing members mirrors the positioning and orientation of the other one of the securing members. The securing members 14, 15 may move toward each other when the securing members move from the securing position to the receiving position, and may move away from each other when the securing members move from the receiving position toward the securing position.

In use, the device 10 with a suitable spacing or separation between the apertures 18, 19 for the desired spacing of the reinforcement bars may be selected for employment on the reinforcement bars positioned in the form \cavity. The device 10 may be aligned in a substantially perpendicular relationship to the orientation of the bars and then moved toward the bars with the bars roughly aligned with the apertures of the device. As the bars move toward the apertures, the bars engages the deflection edge 42 of the deflection portion of the securing member, and cause the deflection portion, as well as the latching portion, of the securing member to move from the securing position to the receiving position with the securing member moved generally away from the opening of the aperture. Once the bar moves into the aperture, and the juncture of the deflection edge and the notch-defining edge passes by the rod, the securing member is able to move back toward the securing position under the influence of gravity. The configuration of the notch-defining edge 40 may be such that a portion of the edge 40 does not tend to allow the securing member to move out of the securing position to the receiving portion when force is applied by a bar in the aperture and notch to the securing member. Additional positioning devices 10 may be utilized at various separation distances along the reinforcement bars to maintain the spacing and positioning of the bars with respect to each other and the form walls. The concrete may then be placed in the form cavity about the bars and the device 10, and the device remains in place in the concrete as it sets up.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A reinforcement bar positioning device, comprising:

an elongated main member having a longitudinal axis, the main member defining a pair of apertures spaced from each other along the longitudinal axis; and at least one securing member mounted on the main member and configured to removably secure a reinforcement bar in one of the apertures of the main member;

wherein an entirety of the at least one securing member pivots between a receiving position and a securing position.

2. The device of claim 1 wherein the securing position is characterized by the securing member securing the reinforcement bar in the aperture; and wherein the receiving position is characterized by the securing member permitting the reinforcement bar to move by the securing member into the aperture of the main member and move by the securing member out of the aperture of the main member.

3. The device of claim 1 wherein openings into the apertures are located on a same lateral side of the longitudinal axis of the main member; and wherein each of the apertures open in a direction that is perpendicular lateral to the longitudinal axis of the main member.

4. The device of claim 1 wherein a portion of the at least one securing member substantially surrounds a reinforcement bar when the bar is positioned in the aperture and the securing member is in a securing position.

5. The device of claim 1 wherein the main member includes at least one positioning portion extending from one end portion of the main member, the at least one positioning portion being located longitudinally outwardly from the aperture on the end of the main member.

6. The device of claim 5 wherein the at least one positioning portion comprises a pair of positioning portions, each of the positioning portions extending in a substantially longitudinal direction from opposite ends portions of the main member.

7. The device of claim 1 wherein the at least one securing member is pivotally mounted on the main member by a pivot.

8. The device of claim 1 wherein the at least one securing member comprises a pair of securing members mounted on the main member, each of the securing members being configured to secure a reinforcement bar in a respective one of the apertures of the main member.

9. The device of claim 1 wherein the at least one securing member includes a latching portion forming a closed perimeter with one of the apertures of the main member when the securing member is in a securing position.

10. The device of claim 9 wherein the latching portion is moved away from an opening of the aperture when the latching portion is moved from the securing position toward a receiving position.

11. The device of claim 9 wherein the latching portion defines a notch, the notch being alignable with the aperture of the main member when the latching portion is the securing position.

12. The device of claim 1 wherein the at least one securing member includes a deflection portion configured to deflect the securing member from a securing position toward a receiving position when the securing member is contacted by a reinforcing bar.

13. The device, comprising:

an elongated main member having a longitudinal axis, the main member defining a pair of apertures spaced from each other along the longitudinal axis; and at least one securing member mounted on the main member and configured to removably secure a reinforcement bar in one of the apertures of the main member;

wherein the at least one securing member moves between a securing position and a receiving position without flexure of the securing member.

14. The device of claim 13 wherein the receiving position of the at least one securing member is characterized by the securing member being positioned to permit a reinforcing bar to move into the aperture of the main member, and wherein the securing position of the securing member is characterized by the securing member blocking removal of a reinforcing bar from the aperture of the main member.

15. The device of claim 13 wherein the at least one securing member is pivotally mounted on the main member by a pivot.

16. The device of claim 13 wherein openings into the apertures are located on a same lateral side of the longitudinal axis of the main member.

17. The device of claim 13 wherein the at least one securing member comprises a pair of securing members mounted on the main member.

18. The device of claim 13 wherein a portion of the at least one securing member substantially surrounds a reinforcement bar when the bar is positioned in the aperture and the securing member is in a securing position.

19. The device of claim 13 wherein the at least one securing member includes a latching portion forming a closed perimeter with one of the apertures of the main member when the securing member is in a securing position.

20. The device of claim 13 wherein the at least one securing member includes a deflection portion configured to deflect the securing member from a securing position toward a receiving position when the securing member is contacted by a reinforcing bar.

* * * * *